United States Patent [19]

Greenberg

[11] 4,025,097

[45] May 24, 1977

[54] SECURITY LOCK LATCH

[76] Inventor: Sanford Greenberg, 33 Wilk Road, Edison, N.J. 08817

[22] Filed: Dec. 3, 1975

[21] Appl. No.: 637,212

[52] U.S. Cl. ..... 292/207; 292/159

[51] Int. Cl.[2] ..... E05C 3/04

[58] Field of Search ..... 292/207, 297, 298, 218, 292/283, 284, 156, 157, 158, 159, 160, 162

[56] References Cited

UNITED STATES PATENTS

| | | | |
|---|---|---|---|
| 1,475,725 | 11/1923 | Steinmark | 292/157 |

FOREIGN PATENTS OR APPLICATIONS

| | | | |
|---|---|---|---|
| 817,669 | 5/1937 | France | 292/159 |
| 827,656 | 9/1953 | Germany | 292/160 |
| 139,868 | 3/1920 | United Kingdom | 292/159 |

*Primary Examiner*—Robert A. Hafer

*Attorney, Agent, or Firm*—Eugene V. Mandel

[57] ABSTRACT

A security latch for use with a pivotable door comprising a long hinge on the door frame with a notched edge, a slidable and rotatable bolt having pressure fingers for restraining the hinge bolt retention means on the door, the bolt restricting hinge motion, the combination restricting door motion; and a decorative protective cover.

5 Claims, 3 Drawing Figures

SECURITY LOCK LATCH

BACKGROUND OF THE INVENTION

This invention relates to security devices. It pertains particularly to latches for doors. More particularly, it relates to latches employing hinges.

Many locks and latches have been known and used in the last three thousands years for securing swingable doors.

Unfortunately, all devices provide only limited security and a constant struggle continues between those seeking security and those trying to destroy it. Many known latches can be relieved by the use of a thin card through a narrow clearance.

The object of this invention is to provide a security device embodying improved principles of design and construction.

An important object of the invention is to provide a security device which is comprised of a minimum number of durable parts or components which can be economically manufactured and assembled.

A significant object of the invention is to provide a security device, so designed and constructed that it can be easily and quickly installed to most of the conventional swinging doors now in use.

A further object of the invention is to provide a security device which may be latched in either the locking or the open position. Yet another object is to provide a security device which can be installed using conventional threaded fasteners.

Still another purpose is to provide a decorative cover for the security device.

The essence of this invention is a security lock latch which has a very long engagement, is latched in the open and closed positions, and is decorative.

An advantage of this latch is that engagement with the fixed doorjamb can be effected via the pianohinge over a length of several feet.

Further objects and advantages of this invention will appear more clearly from the following description of a non-limiting illustrative embodiments and the accompanying drawings in which like numerals designate like parts throughout the several views.

DESCRIPTION OF DRAWINGS

The preferred embodiment of the invention is constructed in accordance with the disclosure thereof in the accompanying drawings, in which.

Figure 1:
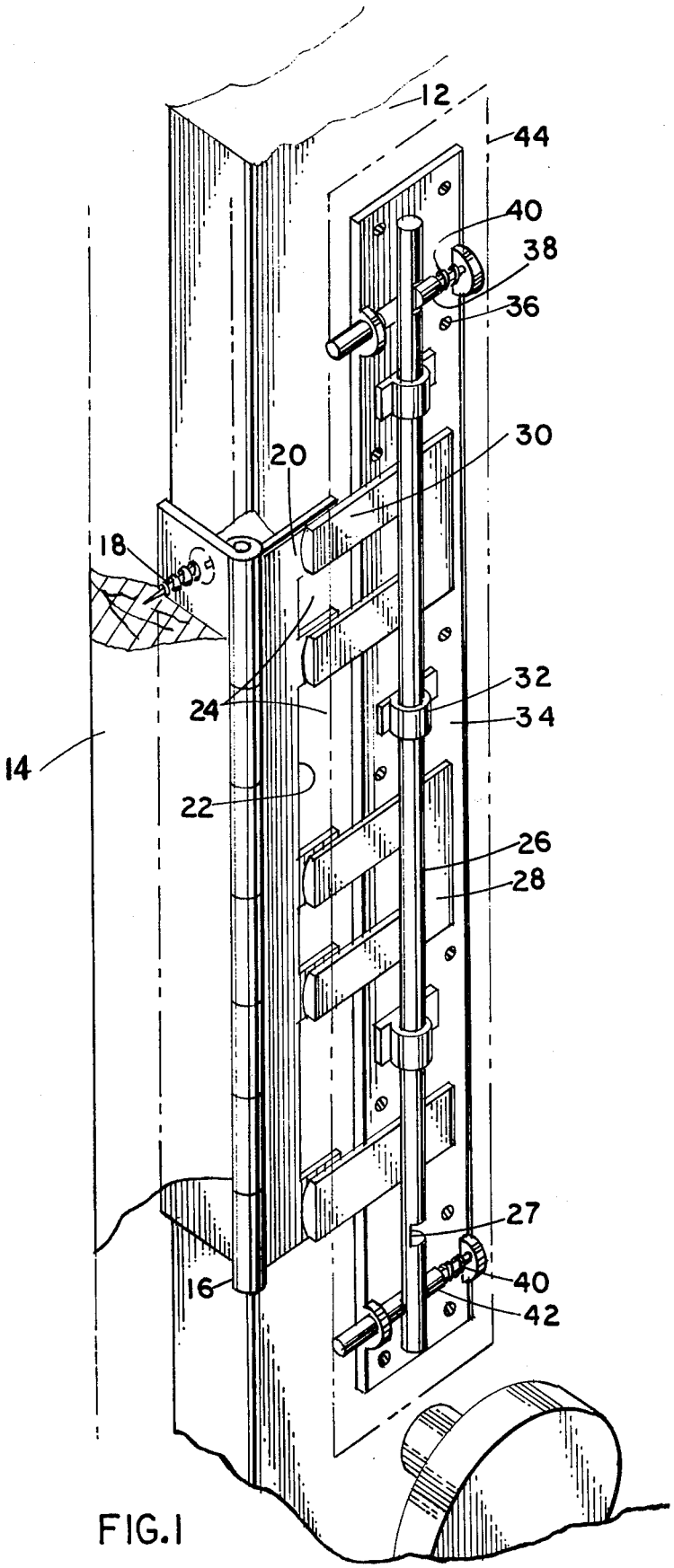
FIG. 1 is a pictorial representation of the security latch's arrangement and assembly incorporating the principles of this invention.
Figure 3:
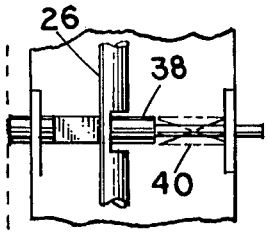
FIG. 3 is a partial view of the release pin assembly.
Figure 2:
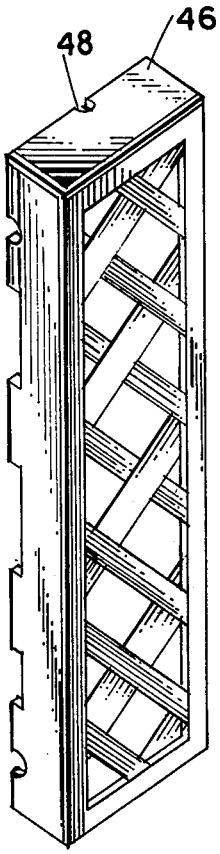
FIG. 2 is a pictorial view of the cover.

In the drawings a security lock latch 10 embodying features of the invention is illusrated.

A piano or long hinge 16 is mounted to the door frame or jamb 14 by the use of screws 18. The free long side of hinge 16 is notched 22 in several places.

Mounting plate 34 is attached to swinging rotatably door 12 by screws 36 through holes 44. Guides 32 for sliding and optionally rotatable bolt rod 26. The guides

32 may be integral parts of plate 34 or may be U clamps or other devices attached to plate 34.

Rod 26 has attached to it or integral with it pressure fingers 30 and pressure offset bar 28. When pressure fingers 30 are aligned with tongues 20 of hinge 16 and rod 26 is restricted from sliding or rotating, the door 12 is effectively prevented from swinging and therefore remains closed.

Rod 26 is notched 27 to match locking guard pins fingers 38, 42 loaded by spring 40 and rod 26 is therefore retained in either the latching position with fingers 30 pressing against tongues 20 or in the unlatched position in which mode fingers 30 are opposite notches 24 and the door can be opened. If desired rod 26 may be rotated in guides 32.

Decorative and protective cover 46 having suitable clearance notches 48 may be provided and would be seated in position 44.

Key lock through the door may be provided with a cam action engaging either rod 26 or locking guard pin fingers 38.

Many pressure fingers 30 and a very long piano hinge 16 may be employed for strength.

Materials employed would be conventional, preferably metals, with corrosion protection required as desired.

The invention includes all novelty residing in the description and drawings. It is obvious to those skilled in the art that various minor changes can be made without departing from the concept of this invention and all such as fall within the reasonable scope of the appended claims are included.

What is claimed is:

1. A security latch for use with a door pivotably mounted to one side of a door frame comprising an elongated hinge comprised of two portions pivotally connected to each other, one said portion mounted to the other side of the door frame, one edge of the other portion of said hinge having a plurality of projections with at least one notch; a bolt slidable on the door parallel to the axis of the hinge, the bolt being provided with pressure fingers to engage the projections on the other portion of said hinge when the bolt is in one position, and to clear said porjections and be moveable through the notch when the bolt is slid to an alternate suitable position, upper and lower locking fingers to retain the bolt in respective positions; the combination of the hinge, the bolt, and bolt retention means restricting hinge motion of said other portion and thereby providing a latch restricting door motion.

2. A security latch as in claim 1 further comprising a cover to enclose the moving parts of said security latch for safety.

3. A security latch as in claim 1 further comprising at least one transverse notch in the bolt into which the locking finger may engage.

4. A security latch as in claim 1 further comprising biasing means for at least one locking finger.

5. A security latch as in claim 4 wherein the biasing means comprises a spring.

* * * * *